United States Patent [19]

England

[11] 3,935,823

[45] Feb. 3, 1976

[54] DROP LEAF TABLE

[75] Inventor: William G. England, Elmhurst, Ill.

[73] Assignee: Bretford Manufacturing, Inc., Schiller Park, Ill.

[22] Filed: Aug. 29, 1974

[21] Appl. No.: 502,110

[52] U.S. Cl. ..... 108/80

[51] Int. Cl.[2] ..... A47B 1/04

[58] Field of Search ..... 108/77, 80–82, 108/133; 297/161, 162, 417

[56] References Cited

UNITED STATES PATENTS

| | | | |
|---|---|---|---|
| 188,414 | 3/1877 | Rohde | 108/80 |
| 1,118,704 | 11/1914 | Tolman | 108/133 |
| 2,740,680 | 4/1956 | Hamilton | 108/80 |

*Primary Examiner*—James C. Mitchell

*Attorney, Agent, or Firm*—Wegner, Stellman, McCord, Wiles & Wood

[57] ABSTRACT

A drop leaf table, usable as a typewriter stand, having a table top and a drop leaf pivotally hinged along a side of the table top and having a brace member for engaging a latch mechanism on the underside of the drop leaf to hold the drop leaf in its raised operative position level with the table top. A tension spring connected with the brace member urges the brace member into following relation and sliding engagement with the underside of the drop leaf throughout the entire movement of the drop leaf from lowered to raised position. The latch mechanism and brace member automatically interengage to maintain the drop leaf in raised position.

10 Claims, 5 Drawing Figures

10
43
31
40
12
11
2.
36
35
60
30
12
17
2.
22
15
18
16
21
20

38
36
32
17
41
47
45
49
3.
62
60
43
61
40
45
3
47
49
46

42
35
32
18
37
31

11
62
60
49
45
46
31
37
43
47
32
40
12
35
65
42
18

11
37
32
60
35
65
5.
5.
42
49
45
46
47
31
18
61
32
43

32
65
35
31
18

DROP LEAF TABLE

BACKGROUND OF THE INVENTION

This invention pertains to a drop leaf table and, more particularly, to such a table usable as a typewriter stand with a table top for supporting a typewriter and a drop leaf which can be moved into raised position level with the table top, and with automatic latching structure for latching a separate brace member to the drop leaf to maintain the latter in raised position.

A variety of strucures is known for holding a drop leaf of a table in raised position level with the table top. Such mechanisms include pivotally-interconnected links which extend and lock together to form a brace to hold the drop leaf in raised position. Also known, is a pivotally-mounted brace member which is manually moved into a support position beneath the drop leaf and into engagement with retention structure which holds the brace member associated with the drop leaf. These structures do not provide a relatively simple brace structure which automatically moves into a latched position with a latch member on the drop leaf when the drop leaf is raised and which has utility with many different types of drop leaf tables including a typewriter table having a top and drop leaf formed of metal.

SUMMARY

A primary feature of this invention is to provide a drop leaf table having a drop leaf in hinged relation to a table top and with a simple brace structure including a brace member which slides along the undeside of the drop leaf as the drop leaf is raised and automatically moves into latched relation with the drop leaf when the drop leaf is in raised position. the continuous contact assures quiet operation, particularly when the table and drop leaf are formed of metal.

In the invention disclosed herein, the brace member is mounted beneath the table top for pivotal movement about an axis between a downwardly extending position when the drop leaf is lowered and an upwardly and outwardly inclined position when the drop leaf is in raised position, with means urging a part of the brace member into engagement with the underside of the drop leaf in all positions of the latter and into latching relation with a latch member on the underside of the drop leaf.

In a preferred embodiment of the invention, the urging means is a tension spring connected to the brace member and fastened to a part of the table at a location whereby spring force acts in all positions of the brace member to urge the brace member toward the drop leaf and with the latch member having an inclined tab with a cam surface which cams the slidably engaging part of the brace member to a position behind the tab to latch the brace member to the latch member and maintain the drop leaf in raised position.

Additionally, a second tab on the underside of the drop leaf is spaced from the first-mentioned tab to form a stop which may engage the part of the brace member and limit pivoting of the drop leaf above a raised position generally level with the table top.

DESCRIPTION OF THE PREFERRED EMBODIMENT

Figure 1:
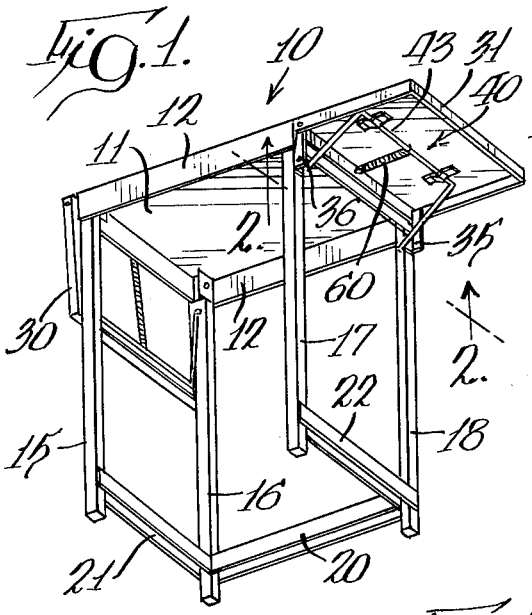
FIG. 1 is a perspective elevational view of the table in tilted position to expose the underside thereof and with one drop leaf in raised position.

The table, indicated generally at 10, has a table top 11 with a series of depending peripheral flanges 12 carrying means for attachment to leg structure including hollow tubular legs 15, 16, 17, and 18. The lower ends of the legs are interconnected by a bottom brace having a section 20 spanning the front legs 16 and 18 and sections 21 and 22 extended between respective ones of the front legs and the rear legs 15 and 17, respectively.

In use of the table 10 as a typewriter table or stand, a person may sit to the rear of the table with the person's legs between the table legs 15 and 17 and with the table top 11 being of a size to support a typewriter. Although not shown, the lower ends of the legs 15-18 may be provided with casters in order to facilitate movement of the table.

In order to increase the work surface of the table, the table is of the drop leaf type and has a pair of drop leaves 30 and 31 positioned one at each side of the table top. As shown in FIG. 1, the drop leaf 30 is in a lowered position and the drop leaf 31 is in a raised, operative position at generally the same level as the table top 11. The construction of each of the drop leaves 30 and 31 is the same as well as the mounting and latching structure associated therewith and further description with respect to the drop leaf 31 and associated structure applies equally to the drop leaf 30.

Figure 3:
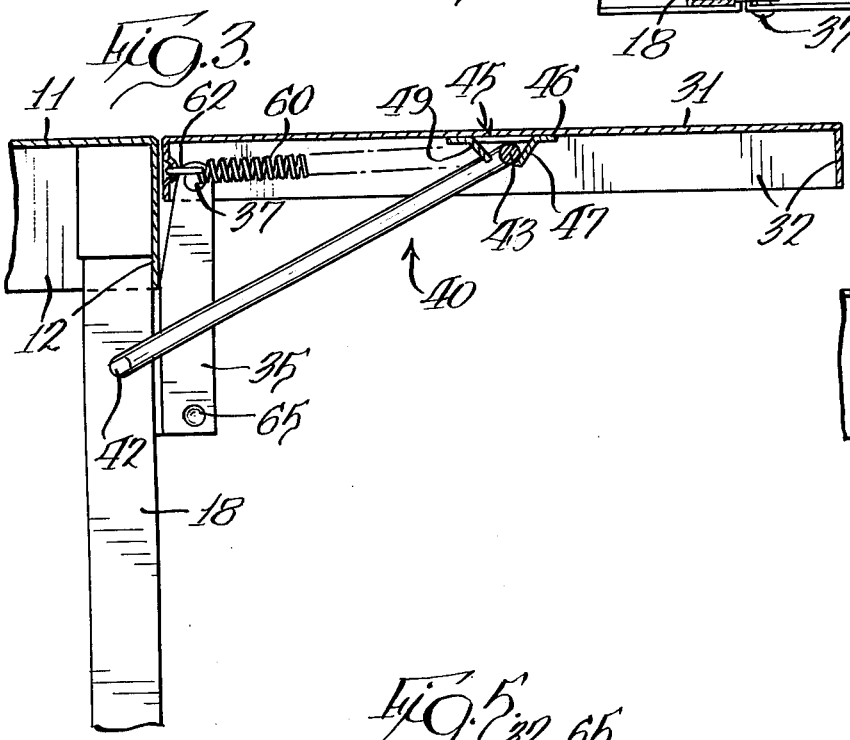
FIG. 3 is a vertical section, taken generally along the line 3—3 in FIG. 2.
Figure 4:
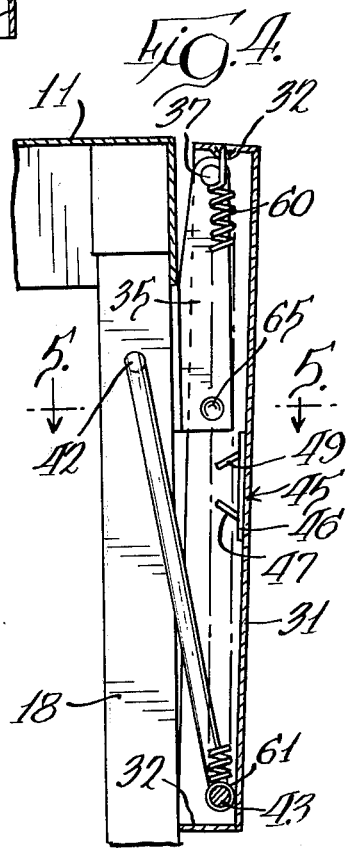
FIG. 4 is a view, similar to FIG. 3, showing the drop leaf in lowered position.

The drop leaf 31 has a generally planar top surface with depending peripheral flanges 32 and is pivotally mounted to one side of the table top 11 for movement between the raised position of FIG. 3 and the lowered position of FIG. 4. The drop leaf is mounted by a pair of hinge plates 35 and 36 suitably fastened to the upper ends of the legs 17 and 18 and each having a self-fastening pin 37 and 38, respectively, extending therethrough as well as through a depending flange 32 of the drop leaf whereby the pins form hinge pins for pivotal movement of the drop leaf.

Figure 2:
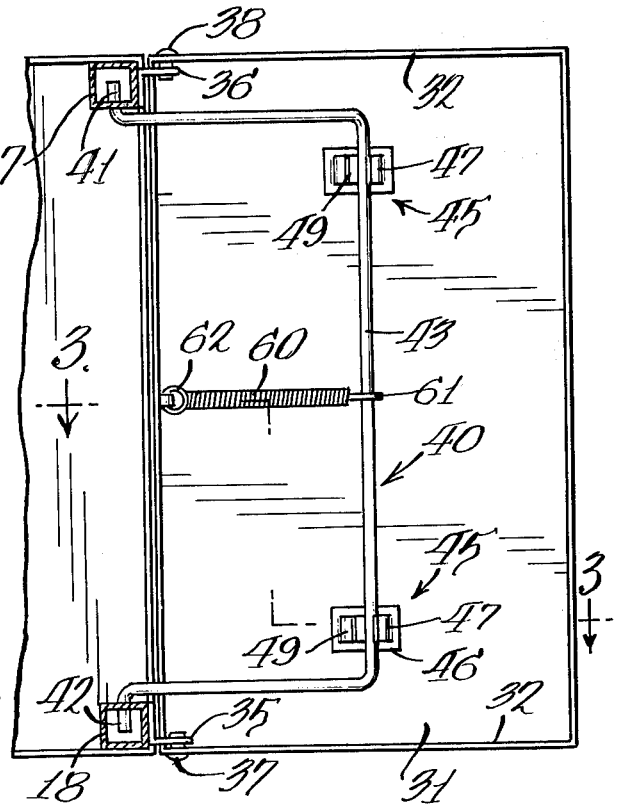
FIG. 2 is a fragmentary bottom plan view, on an enlarged scale, of a portion of the table top and a drop leaf in raised position and taken generally along the line 2—2 in FIG. 1.

The drop leaf 31 is maintained in raised position by a generally U-shaped brace member, indicated generally at 40. The brace member has a pair of ends 41 and 42 each extended through an opening in the wall of the legs 17 and 18, respectively, to pivotally mount the brace member for pivotal movement about an axis defined by a line coaxial with the pins 41 and 42. A central part 43 of the brace member has a length closely approximating the front-to-rear dimension of the drop leaf and which coacts with a latch mechanism, indicated generally at 45, on the underside of the drop leaf. As shown in FIGS. 1 and 2, there are a pair of such latch mechanisms mounted on the underside of the drop leaf in order to provide strong support for the drop leaf. Each latch mechanism includes a plate 46 secured to the underside of the drop leaf and having an inclined tab 47 providing a cam surface for coaction with the central part 43 of the brace member shortly before complete raising of the drop leaf to facilitate the automatic latching of the brace member to the drop leaf.

A second tab 49 is inclined outwardly from the plate 46 and has its outer end spaced from the outer end of the first tab 47 a distance greater than the diameter of the rod stock from which the brace member 40 is formed. This second tab 49 functions as a stop in coacting with the central part 43 of the brace member to limit elevation of the drop leaf 31 beyond the raised position shown in FIG. 3.

The brace member 40 extends downwardly from the pivot axis thereof when the drop leaf 31 is in its lowered position, as shown in FIG. 4, and in an outwardly and upwardly inclined position when in latched relation with the drop leaf as shown in FIG. 3.

The latching relation between the parts shown in FIG. 3 occurs automatically in raising of the drop leaf. This is accomplished by means which urges the part 43 of the brace member into engagement with underside of the drop leaf in all positions of the latter and which maintains the part 43 in sliding engagement with the underside of the drop leaf in movement of the drop leaf from the lowered position of FIG. 4 to the raised position of FIG. 3. More particularly, this urging means is a tension spring 60 having an end 61 connected to the part 43 of the brace member intermediate its ends and with an opposite end 62 fixed at a location to exert force on the brace member 40 in all positions thereof acting to urge the brace member in a counterclockwise direction, as viewed in FIG. 4.

With the pivot axis for the brace member 40 as defined by the pins 41 and 42 being located beneath the table top at an edge thereof, the end 62 of the tension spring 60 is positioned thereabove and specifically is connected to the innermost flange 32 of the drop leaf 31 to have the spring act at an angle to the brace member and exert a spring force causing counterclockwise pivoting of the brace member as permitted by the position of the drop leaf 31. In the lowered position of the drop leaf 31, as shown in FIG. 4, the tension spring 60 has been substantially extended; however, the spring force is acting through a relatively short lever arm to exert a relatively small amount of force on the brace member. The force is not sufficient to cause elevating movement of the drop leaf and it is necessary to manually raise the drop leaf 31 with the force of the spring then causing the part 43 of the brace member to maintain sliding engagement with the underside of the drop leaf. In the raised position of the drop leaf 31, as shown in FIG. 3, the tension spring 60 is under very little extension and, therefore, there is only a minimal amount of force acting to hold the brace member in the latched position.

As seen in FIG. 4, the end 62 of the tension spring 60 is positioned outwardly of the pivot axis for the brace member 40 to prevent the brace member going over center with respect to the spring.

Figure 5:
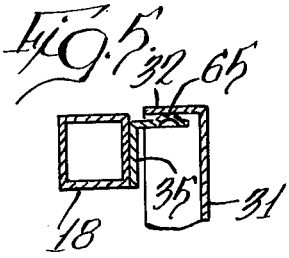
FIG. 5 is a fragmentary sectional view, taken generally along the line 5—5 in FIG. 4.

The components of the table in the preferred embodiment are formed of metal and the drop leaf 31 may be securely held in the lowered position, shown in FIG. 4, by having a dimple 65 formed on each of the hinge members 35 and 36 extending outwardly therefrom to frictionally engage a peripheral flange 32 of the drop leaf. This coaction is shown in FIG. 5.

In use of the table, a person engages the drop leaf in lowered position and raises the drop leaf to the operative level position shown in FIG. 3. During this movement, the brace member 40 is caused to follow the drop leaf, under the urging of the tension spring 60, which maintains intimate contact between these parts to assure quiet operation of the mechanism. In order to obtain the latched relation of the parts shown in FIG. 3, the drop leaf 31 is raised slightly above the level position and the tension spring 60 urges the brace member 40 in a counterclockwise direction with the part 43 thereof engaging the cam surface of the first tab 47 to cam the part 43 of the brace member beyond the first tab 47. The force of the spring 60 then pulls the part 43 of the brace member into a position between the tabs 47 and 49, as permitted by the spacing therebetween, and the drop leaf 31 is then returned to level position and is held locked for use of the table. The second tab 49, in functioning as a stop, limits elevation of the drop leaf 31 so that any attempt to pick up the table by the drop leaf will cause the brace member 40 to limit the upward movement of the drop leaf 31.

For return of the drop leaf 31 to its lowered position, the drop leaf is raised slightly from the position shown in FIG. 3 and the brace member 40 is then manually pivoted a slight amount in the clockwise direction to have the part 43 thereof clear the first tab 47. The drop leaf is then lowered to the position of FIG. 4 and into engagement with the dimples 65 with the brace member merely following to the downwardly-inclined position, shown in FIG. 4.

I claim:

1. A drop leaf table having a table top and at least one pivotally hinged drop leaf along an edge of said table top and movable from a lowered position to a raised operative position forming an extension of said table top, a brace member pivotally mounted relative to the table top with a part thereof for bearing upwardly against the bottom surface of the drop leaf as the drop leaf moves between lowered and raised positions and engageable with a latch member on said bottom surface to hold the drop leaf in said raised position, means for urging said brace member part against said bottom surface of the drop leaf from lowered to raised positions and into engagement with said latch member, said latch member including a first inclined tab and a second tab, said first tab having a cam surface for camming said brace member part over said first tab and placing said brace member part and said first tab in locking relation when said drop leaf is in raised position, and said second tab spaced apart from said first tab for engagement with said brace member part to limit raising of the drop leaf and elevation of the brace member.

2. A drop leaf table as defined in claim 1 wherein said urging means also urges the brace member toward said bottom surface of the drop leaf when the drop leaf is in lowered position, and releasable means for holding said drop leaf in lowered position.

3. A drop leaf table as defined in claim 2 wherein said urging means comprises a tension spring operatively connected to said brace member.

4. A drop leaf table as defined in claim 2 wherein said brace member is pivotally mounted a short distance beneath said table top and extends downwardly when the drop leaf is lowered and upwardly and outwardly when the drop leaf is raised, said urging means includes a tension spring with one end connected to said part of the brace member, and means mounting the other end of the tension spring at a location whereby the tension spring continuously urges the brace member part outwardly toward the drop leaf.

5. A drop leaf table as defined in claim 4 wherein said other end of the spring is located generally above the pivotal mounting of the brace member whereby said tension spring is extended when the drop leaf is in said lowered position and the spring is angularly related to the brace member to exert minimal torque on the brace member.

6. A drop leaf table, comprising: a table having a top and a supporting leg structure; a drop leaf pivotally mounted to said table for rotation about a first axis parallel to said top; a U-shaped brace member with a central portion and a pair of ends for supporting said drop leaf level with said top; means for latching said member against the bottom surface of said drop leaf; means pivotally mounting said brace member for rotation about a second axis parallel to and spaced from said first axis by pivotal mounting of said pair of ends, said brace member having said central portion moving along and in contact with said bottom surface and engaging said latching means; and, means for urging said central portion toward said latching means, the action of the pivotal motion of said brace member effectuating complete engagement of said brace member and said latching means.

7. A typewriter table or stand including a table top with a supporting leg structure and at least one pivotally hinged drop leaf along an edge of the top and which is movable between a lowered position and a raised operative position level with the table top, a generally U-shaped brace member having a central longitudinal part with legs at the opposite ends which are mounted to said supporting leg structure for pivotal movement about an axis fixed relative to and generally beneath said table top edge, said central part of the brace member engaging the bottom surface of the drop leaf in all positions of the drop leaf and in unconfined sliding engagement with said bottom surface during movement of the drop leaf, said brace member extending downwardly from said axis when the drop leaf is in said lowered position and extending upwardly and outwardly when said drop leaf is in said raised position, a latch member on said bottom surface of the drop leaf and engageable with said central part of the brace member to hold the drop leaf in raised position, and means for exerting a yieldable force on said brace member to urge said central part of the brace member to bear against said bottom surface of the drop leaf as the drop leaf is manually raised and to engage the latch member.

8. A typewriter table as defined in claim 7 wherein said yieldable force exerting means comprises a tension spring having one end connected to said brace member and the other end connected to said drop leaf at a location generally above said axis to have a spring force urging the brace member part toward the drop leaf.

9. A typewriter table as defined in claim 7 wherein said latch member includes an inclined tab with a cam surface to cam said brace member part into position behind said tab as the drop leaf reaches said raised operative position.

10. A typewriter table as defined in claim 9 including a second tab spaced from said inclined tab and engageable with said brace member part to limit upward movement of the drop leaf beyond said level position.

* * * * *